US009897422B1

(12) United States Patent
Marietta et al.

(10) Patent No.: US 9,897,422 B1
(45) Date of Patent: Feb. 20, 2018

(54) FIREWORKS AERIAL DISPLAY SHELL WITH MULTIPLE BREAKS AND A METHOD INVOLVING SAME

(71) Applicant: Jake's Fireworks Inc., Pittsburg, KS (US)

(72) Inventors: Michael Marietta, Pittsburg, KS (US); Qiang Li, Hunan (CN)

(73) Assignee: Jake's Fireworks Inc., Pittsburg, KS (US)

( * ) Notice: Subject to any disclaimer, the term of this patent is extended or adjusted under 35 U.S.C. 154(b) by 0 days.

(21) Appl. No.: 15/337,933

(22) Filed: Oct. 28, 2016

(51) Int. Cl.
*F42B 4/24* (2006.01)
*F42B 4/02* (2006.01)

(52) U.S. Cl.
CPC . *F42B 4/24* (2013.01); *F42B 4/02* (2013.01)

(58) Field of Classification Search
CPC ..... F42B 4/24; F42B 4/04; F42B 4/14; F42B 4/06
USPC ..... 102/361, 352, 334, 358, 360, 346; 86/20.1, 20.14, 21, 22
See application file for complete search history.

(56) References Cited

U.S. PATENT DOCUMENTS 1,773,197 A * 8/1930 Mulcahy ..... F42B 27/00 102/334
4,697,518 A * 10/1987 Lau ..... F42B 4/04 102/358
RE38,592 E * 9/2004 Wu ..... F42B 4/06 102/336
7,278,355 B2 * 10/2007 Yu ..... F42B 4/02 102/352
2005/0066837 A1 * 3/2005 Marietta ..... F42B 4/02 102/346
2011/0259229 A1 * 10/2011 Cameron ..... F42B 4/02 102/360

* cited by examiner

*Primary Examiner* — John Cooper
(74) *Attorney, Agent, or Firm* — Hovey Williams LLP

(57) ABSTRACT

A fireworks aerial display shell is provided with multiple casings of cylindrical configuration that are joined together in end-to-end relationship. Each casing defines an interior volume in which an effects charge is packed. A plug is positioned between the effects charges and has an opening through which an ignition source passes to ignite one of the effects charges as a result of burning of another of the effects charges. An outer casing may surround at least parts of the multiple cylindrical casings and includes multiple partially ball-shaped segments.

21 Claims, 6 Drawing Sheets

FIREWORKS AERIAL DISPLAY SHELL WITH MULTIPLE BREAKS AND A METHOD INVOLVING SAME

BACKGROUND OF THE INVENTION

The present invention relates generally to fireworks and, more particularly, to a fireworks aerial display shell, such as a consumer fireworks aerial display shell, of the type intended to be launched from a launch tube of a mortar and to a method of using the aerial display shell to create a pyrotechnic, visual effects display when launched to a desired altitude.

As used herein, "consumer fireworks" has the meaning set forth in Title 27, Code of Federal Regulations, Section 55.11, as small fireworks devices designed to produce visible effects by combustion and which comply with the construction, chemical composition, and other requirements of the U.S. Consumer Product Safety Commission, as set forth in Title 16, Code of Federal Regulations, parts 1500 and 1507.

Consumer fireworks aerial display shells of the type intended to be placed within and then launched from a launch tube of a mortar are well known and are commonly referred to as reloadables. One type of such shells is commonly referred to as ball shells and another type is referred to as canister shells.

A multiple effect or break ball shell is disclosed in U.S. Pat. No. RE38,592 and is characterized by multiple spherical balls that each contain an effects charge of stars and a burst charge. The outer casings of adjacent balls are joined together, such as by a wrapping of glue-soaked threads, and timing or delay fuses extend through aligned holes in adjacent balls to carry an ignition fire from the effects charge in one ball to the effects charge in the next ball. A lift chamber at one end of the ball assembly contains a lift charge connected to a lead fuse, commonly referred to as a shell leader. The lift charge is also connected to a timing fuse that communicates with the effects charge in the lowermost ball shell. The multiple effect ball shells are launched by placing them in a launch tube and lighting the lead fuse, which burns and then ignites the lift charge to propel the balls shells upwardly out of the launch tube to an altitude. The burning timing fuses then cause sequential ignition of the break charges to produce the pyrotechnic visual effects display.

An example of a canister-type aerial display shell is disclosed in U.S. Pat. No. 6,912,958. The aerial display shell disclosed in that patent has a cylindrical casing and a long lead fuse that ignites a lift charge housed at one end of the casing. When ignited, the lift charge propels the aerial display shell upwardly and out of the launch tube. The aerial display shell includes an effects charge, comprising stars and a burst charge, which is separated from the lift charge in the casing and produces the pyrotechnic visual effects display. A timing or delay fuse is used to ignite the effects charge. The burning lift charge ignites the timing fuse, which burns while the aerial display shell is being propelled through the length of the launch tube and during its upward ballistic travel outside the launch tube. The burn time of the timing fuse is set to allow fire to be communicated to the effects charge once the aerial display shell has reached or nearly reached the apex in its ballistic trajectory.

Some enthusiasts prefer balls shells because they have generally been thought to provide a more symmetrical pyrotechnic display than is normally achieved by canister shells. Other enthusiasts prefer canister shells because they are generally thought to provide a louder noise or effect that accompanies the visual pyrotechnic display. Canister shells are generally considerably easier to manufacture than balls shells because their outer cylindrical casing can be pre-formed and presents open ends through which the various internal components can then be sequential loaded and tightly packed. Highly compressing the effects charge can lead to the louder noise that is typically associated with canister shells.

Because the outer casings of ball shells are spherical, they lack the open ends through which the internal components can be readily loaded and tightly packed. As a result, the outer casings of ball shells, in one conventional process, have been made by applying pre-glued paper around the pre-formed pyrotechnic effects charge. In another process, the outer casings of ball shells are pre-formed as separate hemispheres that are separately loaded and packed before being joined together, such as with glue, to form the spherical ball shell. The making of multiple effects ball shells presents additional challenges in securing the spherical surfaces of the balls to each other and in routing the timing fuse from the effects charge in one ball to the effects charge in the adjacent ball. In any event, the process of making ball shells generally requires considerably more labor and skill than the process of making canister shells. As a result, far fewer factories presently produce ball shells than those that produce canister shells. A need has thus arisen for a way to address the preference of some enthusiasts for the appearance or multiple effects of ball shells without the attendant challenges that presently accompany the manufacture of ball shells.

SUMMARY OF THE INVENTION

In one aspect, the present invention is directed to a fireworks aerial display shell comprising first and second casings of cylindrical configuration and positioned in end-to-end relationship. Each of the first and second casings presents opposite first and second ends and defines an interior volume. A lift charge is positioned in the interior volume of the first casing at a location to cause a propelling force to be directed toward the first end of the first casing after the lift charge is ignited. A lead fuse is operatively associated with the lift charge to cause ignition of the lift charge as a result of burning of the lead fuse. A first effects charge is positioned in the interior volume of the first casing between the lift charge and the second end of the first casing for creating a first pyrotechnic display when ignited following ignition of the lift charge. A second effects charge is similarly positioned in the interior volume of the second casing for creating a second pyrotechnic display when ignited. A plug is positioned in the first casing opposite the first effects charge from the lift charge and has an opening for allowing an ignition source to pass through the plug to cause the igniting of the second effects charge following ignition of the first effects charge. In one embodiment, the fireworks aerial display shell described above includes an outer casing surrounding at least parts of said first and second casings and comprising first and second partially ball-shaped segments.

In another aspect, the present invention is directed to a fireworks aerial display shell comprising first and second casings of cylindrical configuration that are joined together in end-to-end relationship. Each of the first and second casings presents opposite first and second ends and define an interior volume. A lift charge is positioned in the interior volume of the first casing at a location to cause a propelling force to be directed toward the first end of the first casing after the lift charge is ignited. A lead fuse is operatively associated with the lift charge to cause ignition of the lift charge as result of burning of the lead fuse. A first effects charge is positioned in the interior volume of the first casing between the lift charge and the second end of the first casing for creating a first pyrotechnic display when ignited following ignition of the lift charge. A delay fuse is operably associated with the lift charge and the first effects charge to cause the delay fuse to burn by said ignition of the lift charge and thereby cause said ignition of the first effects charge. A second effects charge is positioned in the interior volume of the second casing for creating a second pyrotechnic display when ignited. A plug is positioned in the first casing opposite the first effects charge from the lift charge and has an opening for allowing fire resulting from said first effects charge when ignited to pass through the first plug to cause the igniting of the second effects charge. A second delay fuse is operably associated with the second effects charge and the ignition source to cause the second delay fuse to burn as a result of ignition by the ignition source and thereby cause the ignition of the second effects charge a preselected period of time after the ignition of the first effects charge. An outer casing surrounds at least parts of said first and second casings and comprises first and second partially ball-shaped segments.

In a further aspect, the present invention is directed to a a method of creating a multiple effect pyrotechnic display, comprising the steps of launching a fireworks aerial display shell comprising first and second casings of cylindrical configuration and positioned in end-to-end relationship, each of said first and second casings presenting opposite first and second ends and defining an interior volume; creating a first pyrotechnic display after said launching of the fireworks aerial display shell by igniting a first effects charge positioned in the interior volume of the first casing; and then creating a second pyrotechnic display by igniting a second effects charge positioned in the interior volume of the second casing, the igniting of the second effect charge occurring as a result of passing an ignition source through an opening in a plug positioned in the first casing between the first effects charge and the second effects charge.

DETAILED DESCRIPTION

Figure 1:
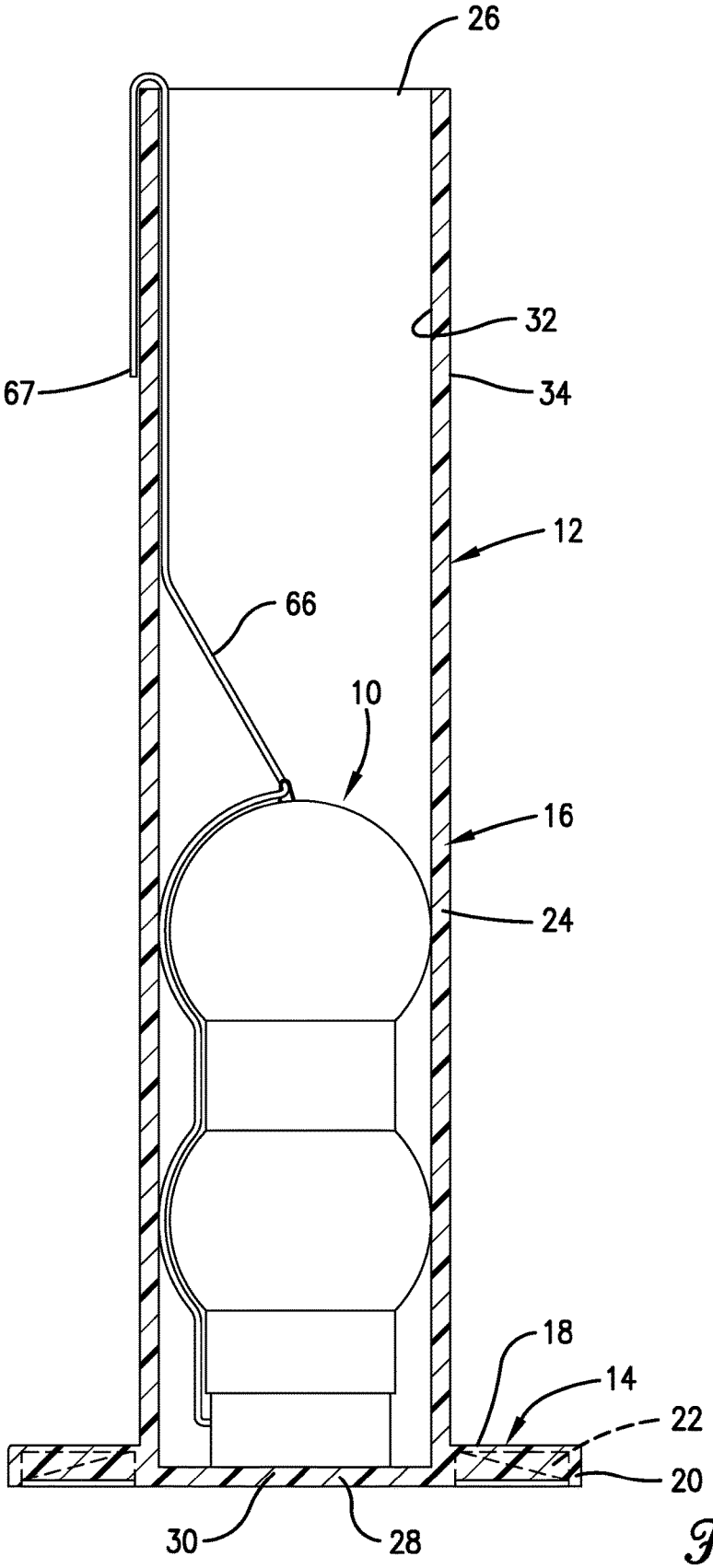
FIG. 1 is a side elevation view of a fireworks aerial display shell of the present invention loaded into a launch tube of a reuseable mortar, with the mortar taken in vertical section to show the aerial shell resting on a closed bottom of the launch tube.

Turning now to the drawings in greater detail and initially to FIG. 1, a fireworks aerial display shell 10, which is normally a consumer fireworks aerial display shell, is shown loaded in a reusable mortar 12 of conventional construction. The mortar 12 includes a base 14 that is adapted to rest on the ground or on another stable support surface and an upstanding launch tube 16 that is secured to the base 14. The base 14 is of a planar, quadrate configuration, with a top wall 18 and a depending sidewall structure 20. The underside of base 14 is equipped with a series of reinforcing webs 22.

The launch tube 16 comprises an upstanding hollow tubular wall 24 that presents an open top or muzzle 26 and a closed bottom or base plug 28. The closed bottom 28 may be formed by a circular base 30 that is of an integral, one-piece construction with the tubular wall 24, or it may be formed in other ways, such as by a portion of the base 14. The tubular wall 24 has opposed inner and outer surfaces 32 and 34 that define a wall thickness. The lower end of launch tube 16 is centrally located in base 14 with the lowermost surface of base 14 being essentially coincident with the bottom margin of the sidewall structure 20.

The base 14 and launch tube 16 are of integral or integrated construction, and are preferably formed of high-density polyethylene. In one embodiment, the base 14 and the launch tube 16 are injection molded as a unitary piece. In other embodiments, the base 14 and the launch tube 16 are separately formed and then integrated together in any of various suitable processes. For example, a heat welding process may be used in which the portions of base 14 and launch tube 16 to be joined together are heated and brought into contact with each other. As another example, a frictional welding process may be used in which the tube 16 is rotated at high speed while pressed against the base 14. In a further example, a suitable adhesive may be used to join the base 14 with the launch tube 16.

The fireworks aerial shell 10 is designed to be loaded into the launch tube 16 of the fireworks launcher 12 through the open top 26 of the tubular wall 24. The fireworks aerial shell 10 is then lowered onto and rests on the closed bottom 28 of the tubular wall 24 before it is launched out of the launch tube 16.

Figure 2:
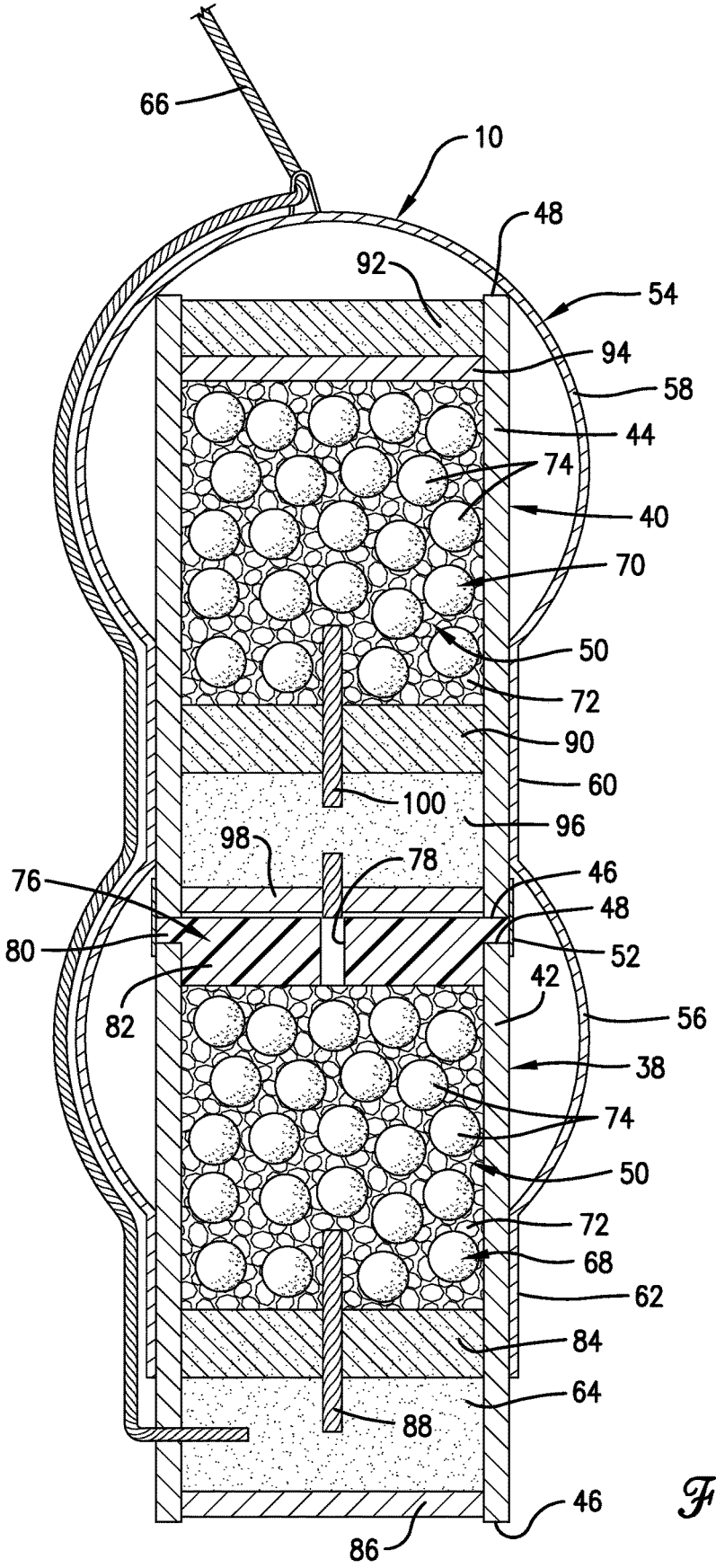
FIG. 2 is an enlarged side elevation view of the fireworks aerial display shell of FIG. 1 and taken in vertical section to show the inner details of the two cylindrical canisters.

As can best be seen in FIG. 2, the fireworks aerial display shell 10 comprises a first canister 38 and a second canister 40 that respectively comprise first and second cylindrical casings 42 and 44 that are of the same diameter and are positioned in end-to-end relationship along their longitudinal lengths. The first and second casings 42 and 44 each present opposite first and second ends 46 and 48 and define an interior volume 50. In one embodiment, the first and second canisters 38 and 40 are separately fabricated and are then joined together in a suitable fashion, such as by using a length of tape 52 wrapped around the outer surfaces of the first and second casings 42 and 44. Alternatively or additionally, glue or other methods of attachment may be used. It will be appreciated that the abutment of the second end 48 of the first casing 42 and the first end 46 of the second casing 44 provides facing surfaces for securing the first and second canisters 38 and 40 together. The aligned outer surfaces of the first and second casings 42 and 44 provide additional surfaces for securely joining the first and second canisters 38 and 40 together, such as with tape 52, and thereby reduce the opportunity for inadvertent separation of the first and second canisters 38 and 40 during shipping and handling.

The fireworks aerial display shell 10 may also include an outer casing 54 surrounding and engaging at least parts of said first and second casings 42 and 44. The outer casing 54 comprises first and second partially ball-shaped segments 56 and 58 that are spaced from each other by a cylindrical intermediate segment 60. The outer casing 54 also includes a cylindrical base segment 62 that is positioned on an opposite side of the first partially ball-shaped segment 56 from the intermediate segment 60. The outer casing 54 is thus intended to replicate the appearance of a traditional double-break ball shell. Inner surfaces of the cylindrical intermediate and base segments 60 and 62 may be adhered to or tightly engage outer surfaces of the first and second casings 42 and 44. This adherence or engagement prevents relative movement between the outer casing 54 and the first and second canisters 38 and 40 and increases the overall rigidity of the fireworks aerial display shell 10.

The fireworks aerial display shell 10 has an outer diameter that is slightly smaller than an inner diameter of the launch tube 16. The outer diameter is that of the outer casing 54, if present. Otherwise, the outer diameter is that of the first and second canisters 38 and 40. In one embodiment, the outer diameter is 4-8 mm less than the inner diameter of the launch tube 16. As one example, the outer diameter of the fireworks aerial display shell 10 is between 20 and 48 mm.

A lift charge 64 is positioned in the interior volume 50 of the first casing 42 at a location at or near the first end 46 of the first casing 42 to cause a propelling force to be directed toward the first end 46 of the first casing after the lift charge 64 is ignited. The lift charge 64 typically comprises granulated black powder, but other suitable materials may be used. As but one example, a composition by weight of about 74% potassium nitrate, 6% sulfur, and 20% carbon, such as charcoal, may be used.

A lead fuse 66 is operatively associated with the lift charge 64 to cause ignition of the lift charge 64 as a result of burning of the lead fuse 66. The lead fuse 66 has a first segment that is positioned external to first and second casings 42 and 44 and the outer casing 54, if present. Another segment of the lead fuse 66 extends through the first casing 42 and into the lift charge 64. The lead fuse 66 is secured in a manner to impede its removal from within the lift charge 64. The length of the first segment of the lead fuse 66 that is external to the first casing 42 is normally sufficient to allow its free end 67 (FIG. 1) to extend upwardly above the muzzle 26 of the tubular wall 24 of the launch tube 16 when the aerial display shell 10 is loaded in the fireworks launcher 12. In one embodiment, the length of the first segment of the lead fuse 66 is at least twice a combined longitudinal length of the first and second casings 42 and 44. In another embodiment, the length of the first segment of the lead fuse 66 is at least three times the combined longitudinal length of the first and second casings 42 and 44.

The burn rate and the length of the lead fuse 66 are selected so that a person may ignite the free end 67 of the lead fuse 66 and move away from the mortar 12 before the lead fuse 66 burns along its length to ignite the lift charge 64. In one embodiment, the burn rate and length, or burn time, of the lead fuse 66 are selected so that a period of time of between 3 and 9 seconds elapses between igniting of the free end 67 of the lead fuse 66 and ignition of the lift charge 64.

A first effects charge 68 is positioned in the interior volume 50 of the first casing 42 between the lift charge 64 and the second end 48 of the first casing 42 for creating a first pyrotechnic display when the first effects charge 68 is ignited following ignition of the lift charge 64. A second effects charge 70 is positioned in the interior volume 50 of the second casing 44 for creating a second pyrotechnic display when the second effects charge 70 is ignited. In one embodiment, the first and second effects charges 68 and 70 each comprise a burst charge 72 and a quantity of effects producing stars 74. The burst charge 72 may comprise a composition by weight of 22% potassium perchlorate, 48% potassium nitrate, 26% carbon, typically charcoal, and 4% polished gelatinous rice powder. The effects producing stars 74 may be of a chrysanthemum type that creates a white or colored spherical break pattern with visible trails of sparks (coruscations), or they may be of a peony type that creates a white or colored spherical break pattern without visible trails of sparks. Of course, other types of effects may be produced and are within the scope of the invention. One composition by weight of the effects producing stars 74 comprises 40% potassium perchlorate, 25% strontium carbonate, 20% aluminum-magnesium, 10% phenolic resin, and 5% polyvinyl chloride.

A plug 76 is positioned in the first casing 42 opposite the first effects charge 68 from the lift charge 64 and extends across the internal cross section of the first casing 42. The plug 76 has an opening 78 that is normally centrally located and extends in the longitudinal direction through the plug 76 for allowing an ignition source to pass through the plug 76 to cause the second effects charge 70 to be ignited a period of time following ignition of the first effects charge 72. The ignition source may be fire resulting from ignition of the first effects charge 68 or it may be a fuse (not shown) that extends through the opening 78 and burns when ignited by the first effects charge 68.

The plug 76 may be formed of various materials, including various polymers, paper, glue, paste, cement, calcite, and/or clay, such as in the form of a compacted clay powder. In one example, the plug 76 is made of high-density polyethylene. In one embodiment, the plug 76 is positioned at the second end 48 of the first casing 42 and has a peripheral lip 80 that extends outwardly from a main body 82 of the plug 76. The main body 82 of the plug 76 has an outer diameter that is only slightly smaller than an inner diameter of the first casing 42 so that the plug 76 may be press-fit into the first casing 42 through its second end 48. The peripheral lip 80 of the plug 76 creates a shoulder that operates as a stop when it is brought into engagement with the second end 48 of the first casing 42.

The first effects charge 68 is isolated from the lift charge 64 in the first canister 38 by a partition 84 that extends across an inner cross section of the first casing 42. The first effects charge 68 is thus positioned between the partition 84 and the plug 76 and may be tightly compacted so that it produces the loud noise characteristic of canisters when ignited. The partition 84 comprises a layer of material that is incombustible during ignition of the lift charge 64. In one embodiment, the material is a clay, such as in the form of a compacted clay powder. In other embodiments, the material may be a polymeric material, glue, paste, cement, calcite, or other materials. Another partition 86 is positioned at the lower or first end 46 of the first casing 38 so that the lift charge 64 is retained between the partition 84 and the partition 86. The partition 86 may be made of the same materials as partition 84 or it may be made of paper to impede moisture intrusion into the lift charge 64.

A timing or delay fuse 88 operatively associates the lift charge 64 with the first effects charge 68 to cause the first effects charge 68 to be ignited as a result of the burning of the lift charge 64. The delay fuse 88 normally extends from the lift charge 64 upwardly through the partition 84 and into the first effects charge 68. In one embodiment, the burn rate and length of the delay fuse 88 are selected so that a period of time of between 2 and 5 seconds elapses between the ignition of the delay fuse 88 by the burning lift charge 64 and igniting of the first effects charge 68 by the burning delay fuse 88.

The second canister 40 has lower and upper partitions 90 and 92 positioned on opposite sides of the second effects charge 70. The partitions 90 and 92 may be made of the same materials as partition 84 to allow high compaction of the second effects charge 70. Another partition 94 made of paper or similar material may be located between the second effects charge 70 and the upper partition 92 or on the opposite side of the upper partition 92 to impede moisture intrusion into the second effects charge 70 from the second end 48 of the second canister 40.

The second canister 40 may have an optional ignition charge 96 made of black powder that is separated from the second effects charge 70 by the lower partition 90. Another partition 98, such as one made of paper or similar material, is positioned at the lower first end 46 of the second casing 44 to hold the ignition charge 96 in place. A timing or delay fuse 100 extends upwardly through the lower partition 90 and into the second effects charge 70 so that burning of the delay fuse 100 will cause ignition of the second effects charge 70. If the ignition charge 96 is present, a lower end of the delay fuse 100 extends into the ignition charge 96 so that burning of the ignition charge causes ignition of the delay fuse 100. The delay fuse 100 may extend downwardly through the partition 98 and is positioned in alignment with and near an upper end of the opening 78 in the plug 76 at the upper or second end of the first casing 42. In another embodiment, the delay fuse 100 may extend into or even completely through the opening 78. When delay fuse 100 is positioned in or near the opening 78, the ignition source passing through the opening 78 causes ignition of the delay fuse 100, which in turn causes ignition of the ignition charge 96.

Alternatively, the delay fuse 100 may be segmented so that a lower portion extends upwardly from or within the opening 78, through the partition 98, and ends within the ignition charge 96. Another portion then extends from within the ignition charge 96 through the partition 90 and into the second effects charge 70. As mentioned above, the ignition charge 96 is optional. When present, the ignition charge 96 facilitates the reliable burning of the delay fuse 100 to cause ignition of the second effects charge 70. When the ignition charge 96 is omitted, the delay fuse 100 extends downwardly from within the second effects charge 70, through the partition 96, and near or into the opening 78 in the plug 76.

In one embodiment, the burn rate and length of the delay fuse 100 are selected so that a period of time of between 2 and 5 seconds elapses between the ignition of the delay fuse 100 by the ignition source and igniting of the second effects charge 70 by the burning delay fuse 100.

The total quantity of pyrotechnics that may be used in the aerial display shell 10 may be limited by regulation. For example, the US Department of Transportation, as set forth in Title 49, Code of Federal Regulations, limits the total quantity of pyrotechnics to no more than 60 grams. Aerial display shells 10 made to comply with that regulation may, in one embodiment, include 5-10 grams of pyrotechnics in first lift charge 64, 45-60 grams of pyrotechnics collectively in the first and second effects charges 68 and 70, and less than 1 gram of pyrotechnics in the fusing. As one example, the first lift charge 68 may have approximately 8 grams of pyrotechnics, the burst charges 72 collectively in the first and second effects charges 68 and 70 may have 10 grams of pyrotechnics, and the effects producing stars 74 may collectively have 42 grams of pyrotechnics. The recited quantities of pyrotechnics may need to be slightly adjusted to account for the quantity of pyrotechnics contained in the fusing described above. Other quantities of pyrotechnics may, of course, be used.

In use in a method of the present invention, the fireworks aerial display shell 10 is loaded into the launch tube 16 with the lower or first end 46 of the first casing 42 resting on the base 30. The free end 67 of the lead fuse 66 is ignited outside of the launch tube 16 and burns along its length to cause ignition of the lift charge 64 as the segment of the lead fuse 66 within the lift charge 64 ignites. The ignition of the lift charge 64 launches the aerial display shell out of the launch tube 16 to a preselected altitude before the burning delay fuse 88, which was ignited by the burning lift charge 64, causes ignition of the first effects charge 64 and thereby create the first pyrotechnic display, which is accompanied by the loud noise characteristic of canister shells. The burning of the first effects charge 64 causes an ignition source to pass through the opening 78 in the plug 76 and ignite the delay fuse 100 in the second canister 40. The delay fuse 100 then burns and causes ignition of the second effects charge 70 to create the second pyrotechnic display a preselected period of time after the first pyrotechnic display. The second pyrotechnic display is also which is accompanied by the loud noise characteristic of canister shells.

In one exemplification of the aerial display shell 10, the period of time between igniting the free end 67 of the lead fuse 66 and its igniting of the lift charge 66 is approximately six seconds, the period of time between ignition of the delay fuse 88 in the first canister 38 by the burning lift charge 64 and its ignition of the first effects charge 68 is approximately 3 seconds, and the period of time between ignition of the delay fuse 100 in the second canister 40 and its ignition of the second effects charge 70 is approximately 1 second.

Figure 3:
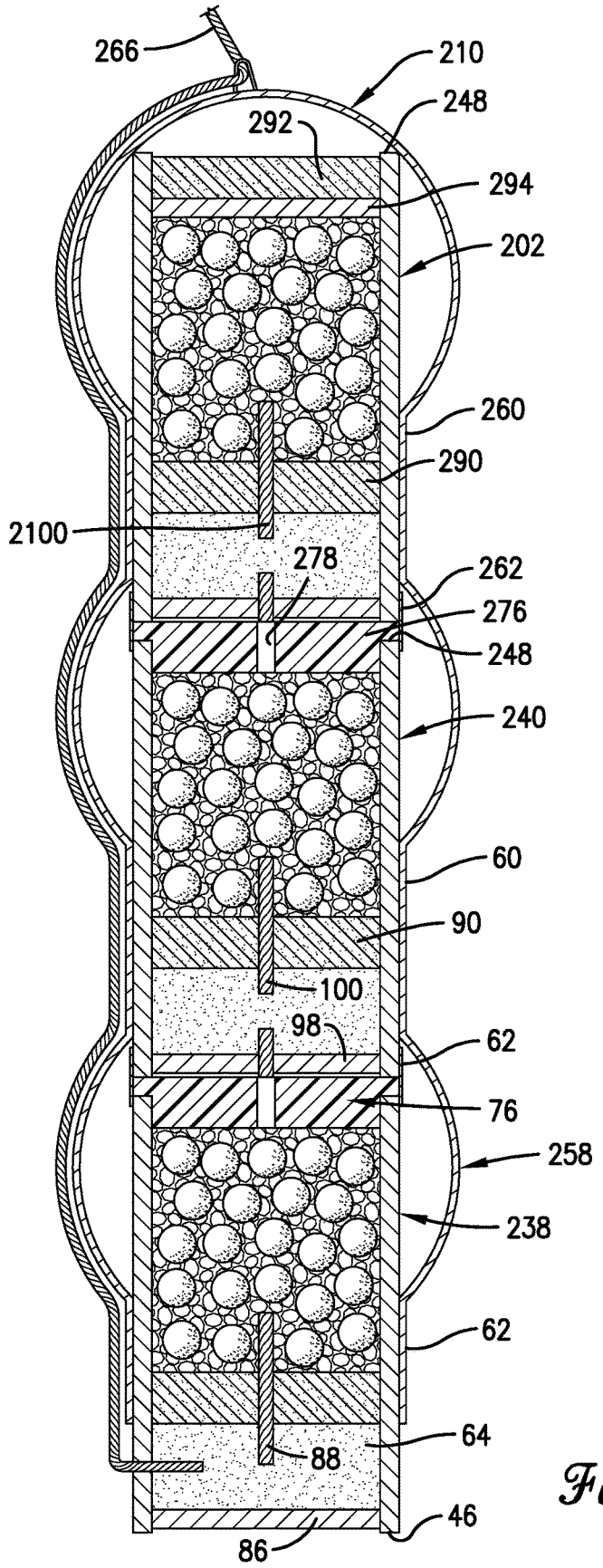
FIG. 3 is a side elevation view of a second embodiment of a fireworks aerial display shell that is similar to that depicted in FIG. 2, except it includes a third cylindrical canister.
Figure 4:
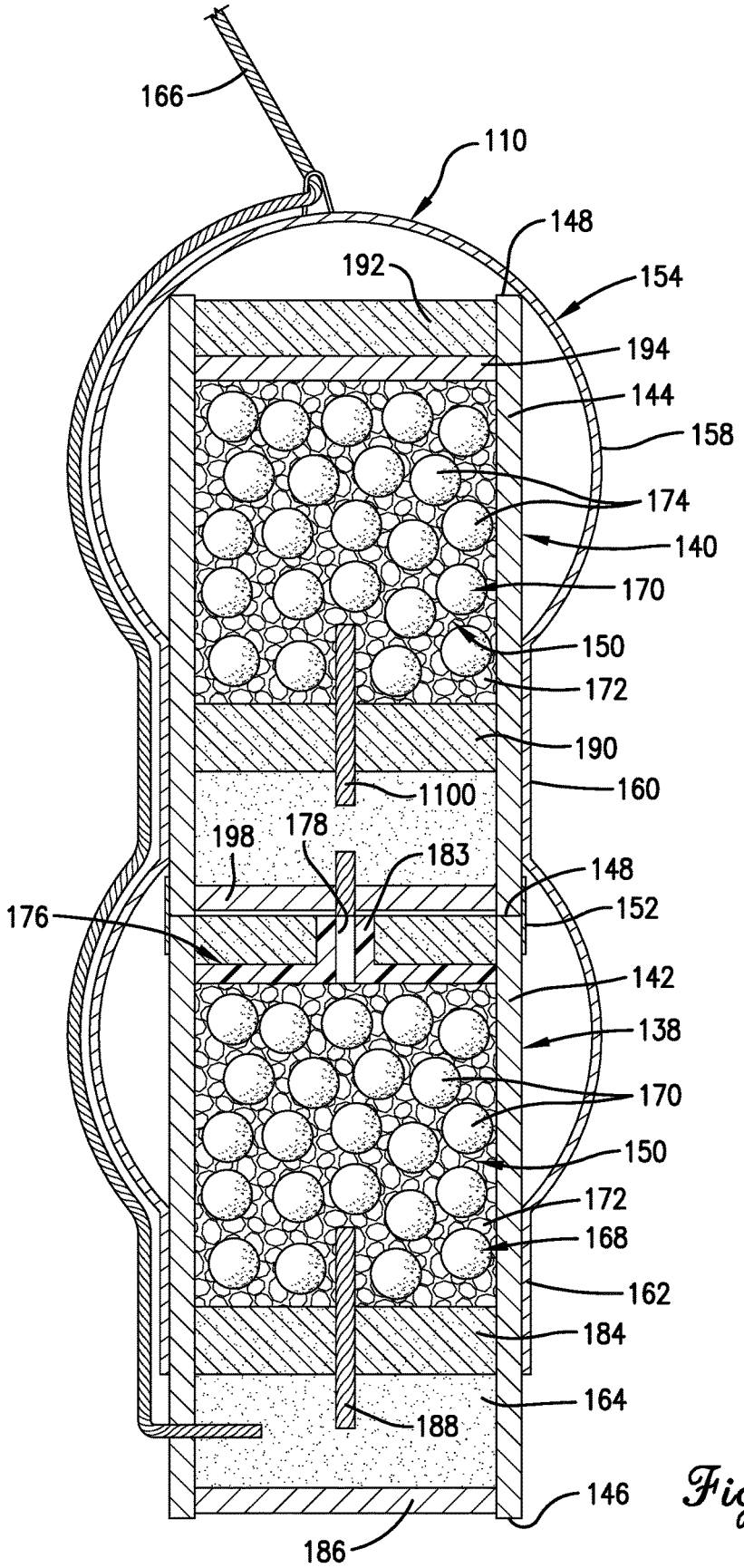
FIG. 4 is a side elevation view of a third embodiment of a fireworks aerial display shell that is similar to that depicted in FIG. 2, but uses a different plug at an upper end of the first cylindrical canister.

In a second embodiment of the fireworks aerial display shell 110 shown in FIG. 3, the plug 76 used with the first embodiment of the aerial display shell 10 may be replaced with a plug 176 of a different construction. The remaining components are the same as described with respect to aerial display shell 10 and are preceded with the prefix "1" for ease of comparison with their like components. The plug 176 may be made from the same materials as plug 76 and has an opening 178 that extends through a disc-shaped main body 182 and a cylindrical extension 183 that extends upwardly from the main body 182. In one embodiment, a material, such a clay such as in the form of a clay powder, is compacted on top of the main body 182 and around the cylindrical extension 183 to complete the plug 176 and hold it securely in place. It will be appreciated that other forms of the plug 76 and 176 may be used.

While the invention has been described with respect to a fireworks aerial display shell having first and second canisters 38 and 40, it will be appreciated that more than two canisters may be used. For example, in the embodiment of the aerial display shell 210 illustrated in FIG. 3, three canisters are used. Like components have been designated with the same numbers preceded by the prefix "2". The construction of the first canister 238 is the same as previously described. The second canister 240 differs from that previously described in that it has a plug 276 and opening 278 at its upper or second end 248 of the type used with the previously described with respect to the first canister 38. A third canister 202 has the same construction as the second canister 240, except that its upper or second end 248 has partitions 292 and 294 that are like the partitions 92 and 94 previously described with respect to second canister 40. The method of using the aerial display shell 210 is that same as that previously described except the third canister 238 creates a third pyrotechnic display a preselected period of time after the second pyrotechnic display. It will be appreciated that in all of the embodiments, the pyrotechnic displays created by the effects charges may be the same or different from each other.

Figure 5:
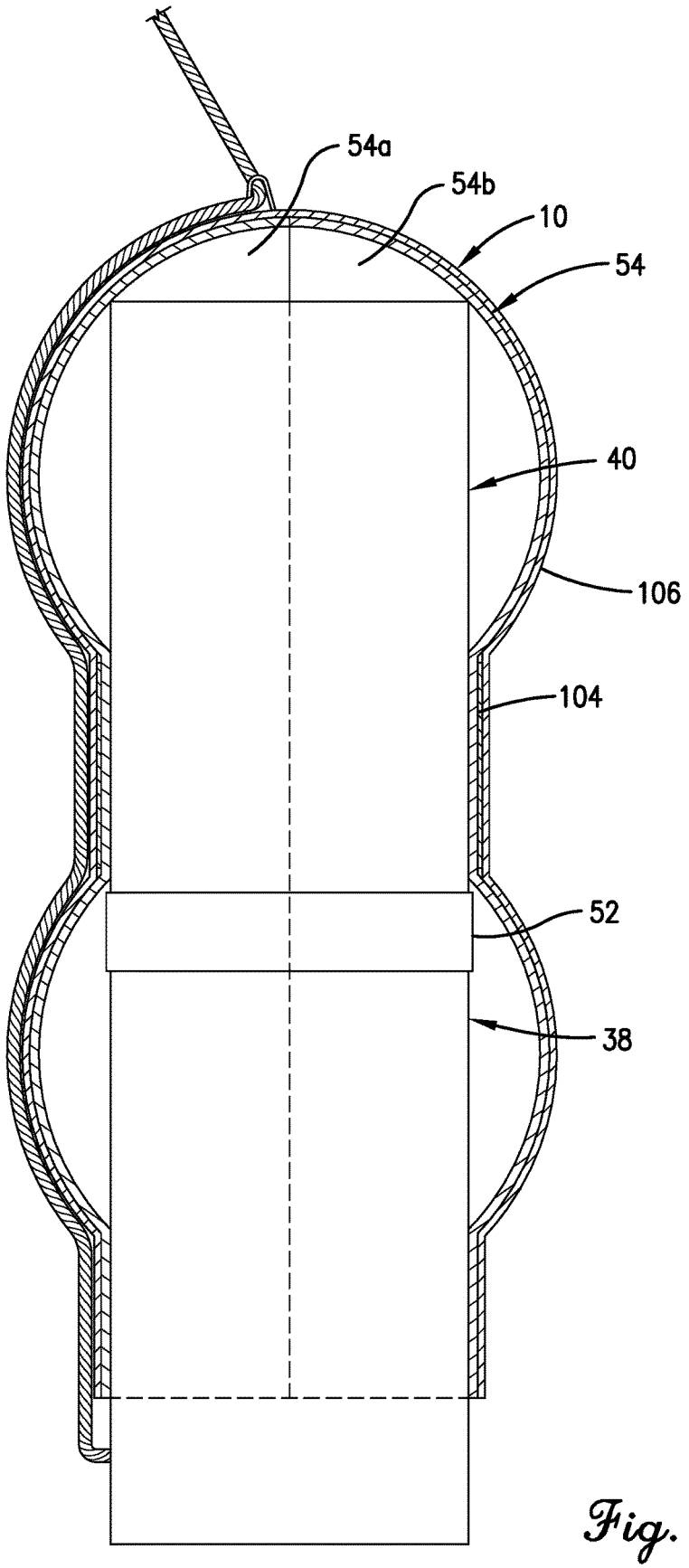
FIG. 5 is a side elevation view of the fireworks aerial display shell of FIG. 2 or 4, with an outer casing shown in vertical section to show one type of construction.
Figure 6:
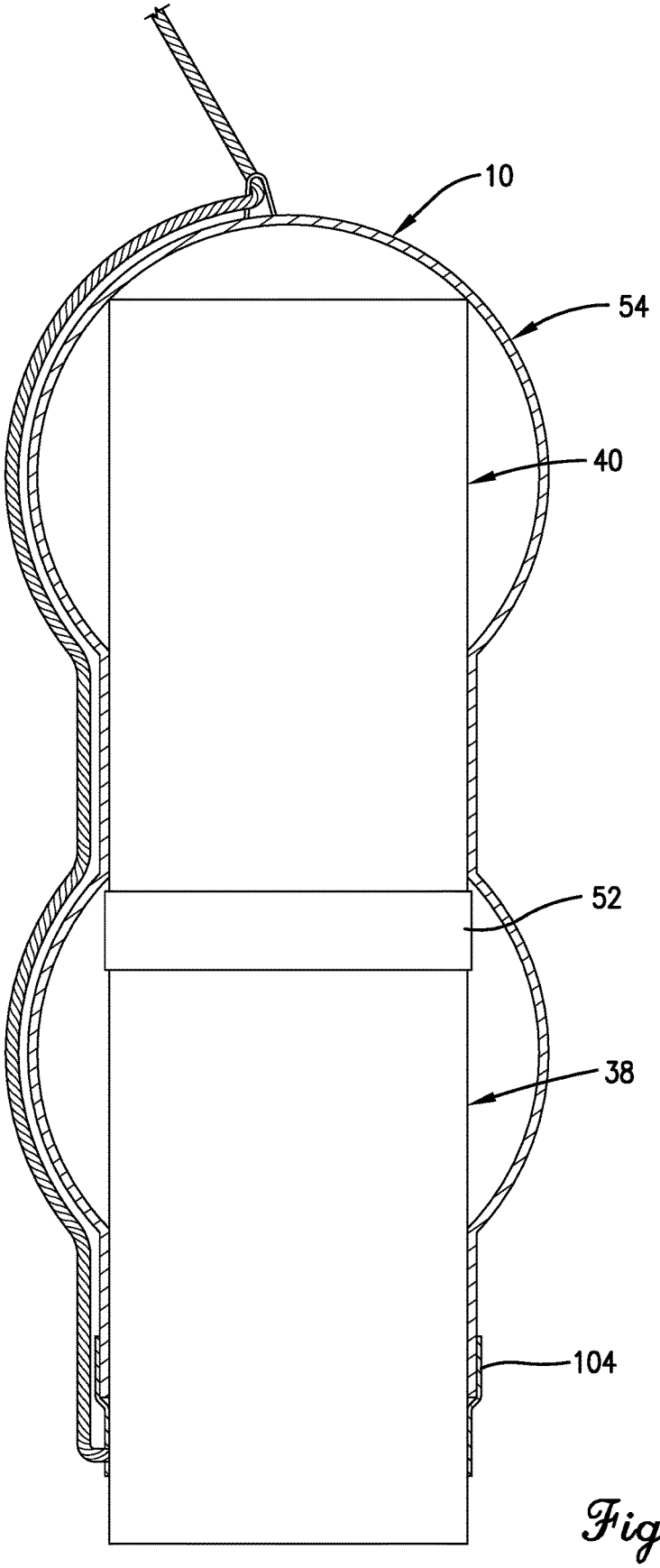
FIG. 6 is a side elevation view of the fireworks aerial display shell of FIG. 2 or 4, with an outer casing shown in vertical section to show another type of construction.

Turning now to FIGS. 5 and 6, the outer casing 54 may be formed as two halves 54*a* and 54*b* that are secured together around the joined first and second canisters 38 and 40. The two halves 54*a* and 54*b* may be glued together along their abutting surfaces, taped together by a length of tape 104, and/or wrapped in a covering 106 such as formed by pre-glued paper. Of course, other means can be used to secure the two halves 54*a* and 54*b* together. In the embodiment shown in FIG. 6, the outer casing 54 is formed as a sleeve that is open at its lower end to permit insertion of the joined first and second canisters 38 and 40. Tape 104, glue and/or other means of securement of the sleeve-like outer casing 54 to the joined first and second canisters 38 and 40.

From the foregoing, it will be seen that this invention is one well adapted to attain all the ends and objectives hereinabove set forth together with other advantages that are inherent to the structure.

It will be understood that certain features and sub combinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A fireworks aerial display shell comprising:

first and second casings of cylindrical configuration and positioned in end-to-end relationship, each of said first and second casings presenting opposite first and second ends and defining an interior volume;

a lift charge positioned in the interior volume of the first casing at a location to cause a propelling force to be directed toward the first end of the first casing after the lift charge is ignited;

a lead fuse operatively associated with the lift charge to cause ignition of the lift charge as a result of burning of the lead fuse;

a first effects charge positioned in the interior volume of the first casing between the lift charge and the second end of the first casing for creating a first pyrotechnic display when ignited following ignition of the lift charge;

a second effects charge positioned in the interior volume of the second casing for creating a second pyrotechnic display when ignited; and a plug positioned in the first casing opposite the first effects charge from the lift charge and extending across an inner cross section of the first casing, said plug having an opening for allowing an ignition source to pass through the plug to cause said igniting of the second effects charge following ignition of the first effects charge.

2. The fireworks aerial display shell of claim 1, including an outer casing surrounding at least parts of said first and second casings and comprising first and second partially ball-shaped segments.

3. The fireworks aerial display shell of claim 2, including a delay fuse operably associated with said lift charge and the first effects charge to cause the delay fuse to be ignited by said ignition of the lift charge and thereby cause said ignition of the first effects charge.

4. The fireworks aerial display shell of claim 3, including a second delay fuse operably associated with said second effects charge and the ignition source to cause the second delay fuse to burn as a result of ignition by the ignition source and thereby cause said ignition of the second effects charge a preselected period of time after said ignition of the first effects charge.

5. The fireworks aerial display shell of claim 1, wherein said plug comprises a main body and a peripheral lip that extends outwardly from the main body of the plug, wherein said main body has an outer diameter sized to allow the main body to be press-fit into the first casing through its second end.

6. The fireworks aerial display shell of claim 1, including a partition extending across an inner cross section of the first casing opposite said first effects charge from said plug.

7. The fireworks aerial display shell of claim 6, including partitions extending across an inner cross section of the second casing on opposite sides of said second effects charge.

8. The fireworks aerial display shell of claim 7, wherein one or more of said partitions comprise compacted clay.

9. The fireworks aerial display shell of claim 1, wherein said ignition source comprises either fire from said first effects charge when ignited or a fuse.

10. The fireworks aerial display shell of claim 1, including:

a third cylindrical casing positioned end-to-end with said second cylindrical casing;

a third effects charge positioned in the interior volume of the third casing for creating a third pyrotechnic display when ignited; and a second plug positioned in the second casing opposite the second effects charge from the first cylindrical casing and having an opening for allowing an ignition source to pass through the second plug to cause said igniting of the third effects charge a preselected period of time following ignition of the second effects charge.

11. A fireworks aerial display shell comprising:

first and second casings of cylindrical configuration and positioned in end-to-end relationship, each of said first and second casings presenting opposite first and second ends and defining an interior volume;

a lift charge positioned in the interior volume of the first casing at a location to cause a propelling force to be directed toward the first end of the first casing after the lift charge is ignited;

a lead fuse operatively associated with the lift charge to cause ignition of the lift charge as a result of burning of the lead fuse;

a first effects charge positioned in the interior volume of the first casing between the lift charge and the second end of the first casing for creating a first pyrotechnic display when ignited following ignition of the lift charge;

a second effects charge positioned in the interior volume of the second casing for creating a second pyrotechnic display when ignited;

a plug positioned in the first casing opposite the first effects charge from the lift charge and having an opening for allowing an ignition source to pass through the plug to cause said igniting of the second effects charge following ignition of the first effects charge an outer casing surrounding at least parts of said first and second casings and comprising first and second partially ball-shaped segments;

a delay fuse operably associated with said lift charge and the first effects charge to cause the delay fuse to be ignited by said ignition of the lift charge and thereby cause said ignition of the first effects charge;

a second delay fuse operably associated with said second effects charge and the ignition source to cause the second delay fuse to burn as a result of ignition by the ignition source and thereby cause said ignition of the second effects charge a preselected period of time after said ignition of the first effects charge;

an ignition charge positioned in said second casing between the second effects charge and the plug in the first casing to receive and become ignited by said ignition source when passing through the opening in the plug and to, in turn, cause said ignition of the second delay fuse.

12. A fireworks aerial display shell comprising:

first and second casings of cylindrical configuration and positioned in end-to-end relationship, each of said first and second casings presenting opposite first and second ends and defining an interior volume;

a lift charge positioned in the interior volume of the first casing at a location to cause a propelling force to be directed toward the first end of the first casing after the lift charge is ignited;

a lead fuse operatively associated with the lift charge to cause ignition of the lift charge as a result of burning of the lead fuse;

a first effects charge positioned in the interior volume of the first casing between the lift charge and the second end of the first casing for creating a first pyrotechnic display when ignited following ignition of the lift charge;

a second effects charge positioned in the interior volume of the second casing for creating a second pyrotechnic display when ignited; and a plug positioned in the first casing opposite the first effects charge from the lift charge and having an opening for allowing an ignition source to pass through the plug to cause said igniting of the second effects charge following ignition of the first effects charge;

a partition extending across an inner cross section of the first casing and positioned to isolate the first effects charge from the lift charge; and another partition positioned at a lower end of the first casing so that the lift charge is retained between the partitions.

13. A fireworks aerial display shell comprising:

first and second casings of cylindrical configuration and joined together in end-to-end relationship, each of said first and second casings presenting opposite first and second ends and defining an interior volume;

a lift charge positioned in the interior volume of the first casing at a location to cause a propelling force to be directed toward the first end of the first casing after the lift charge is ignited;

a lead fuse operatively associated with the lift charge to cause ignition of the lift charge as result of burning of the lead fuse;

a first effects charge positioned in the interior volume of the first casing between the lift charge and the second end of the first casing for creating a first pyrotechnic display when ignited following ignition of the lift charge;

a delay fuse operably associated with said lift charge and the first effects charge to cause the delay fuse to burn by said ignition of the lift charge and thereby cause said ignition of the first effects charge;

a second effects charge positioned in the interior volume of the second casing for creating a second pyrotechnic display when ignited;

a plug positioned in the first casing opposite the first effects charge from the lift charge and extending across an inner cross section of the first casing, said plug having an opening for allowing fire resulting from said first effects charge when ignited to pass through the first plug to cause said igniting of the second effects charge;

a second delay fuse operably associated with said second effects charge and the ignition source to cause the second delay fuse to burn as a result of ignition by the ignition source and thereby cause said ignition of the second effects charge a preselected period of time after said ignition of the first effects charge; and an outer casing surrounding at least parts of said first and second casings and comprising first and second partially ball-shaped segments.

14. The fireworks aerial display shell of claim 13, wherein said plug comprises a disc-shaped main body and a cylindrical extension that extends upwardly from the main body extends across an inner cross section of the first casing.

15. The fireworks aerial display shell of claim 13, including a partition extending across an inner cross section of the first casing and positioned to isolate the first effects charge from the lift charge in the first casing.

16. The fireworks aerial display shell of claim 15, including another partition positioned at a lower end of the first casing so that the lift charge is retained between the partitions.

17. The fireworks aerial display shell of claim 16, including partitions extending across an inner cross section of the second casing on opposite sides of said second effects charge.

18. The fireworks aerial display shell of claim 17, wherein one or more of said partitions comprise compacted clay.

19. A fireworks aerial display shell comprising:

first and second casings of cylindrical configuration and joined together in end-to-end relationship, each of said first and second casings presenting opposite first and second ends and defining an interior volume;

a lift charge positioned in the interior volume of the first casing at a location to cause a propelling force to be directed toward the first end of the first casing after the lift charge is ignited;

a lead fuse operatively associated with the lift charge to cause ignition of the lift charge as result of burning of the lead fuse;

a first effects charge positioned in the interior volume of the first casing between the lift charge and the second end of the first casing for creating a first pyrotechnic display when ignited following ignition of the lift charge;

a delay fuse operably associated with said lift charge and the first effects charge to cause the delay fuse to burn by said ignition of the lift charge and thereby cause said ignition of the first effects charge;

a second effects charge positioned in the interior volume of the second casing for creating a second pyrotechnic display when ignited;

a plug positioned in the first casing opposite the first effects charge from the lift charge and having an opening for allowing fire resulting from said first effects charge when ignited to pass through the first plug to cause said igniting of the second effects charge;

a second delay fuse operably associated with said second effects charge and the ignition source to cause the second delay fuse to burn as a result of ignition by the ignition source and thereby cause said ignition of the second effects charge a preselected period of time after said ignition of the first effects charge;

an outer casing surrounding at least parts of said first and second casings and comprising first and second partially ball-shaped segments; and an ignition charge positioned in said second casing between the second effects charge and the plug in the first casing to receive and become ignited by said ignition source when passing through the opening in the plug and to, in turn, cause said ignition of the second delay fuse.

20. A fireworks aerial display shell comprising:

first and second casings of cylindrical configuration and joined together in end-to-end relationship, each of said first and second casings presenting opposite first and second ends and defining an interior volume;

a lift charge positioned in the interior volume of the first casing at a location to cause a propelling force to be directed toward the first end of the first casing after the lift charge is ignited;

a lead fuse operatively associated with the lift charge to cause ignition of the lift charge as result of burning of the lead fuse;

a first effects charge positioned in the interior volume of the first casing between the lift charge and the second end of the first casing for creating a first pyrotechnic display when ignited following ignition of the lift charge;

a delay fuse operably associated with said lift charge and the first effects charge to cause the delay fuse to burn by said ignition of the lift charge and thereby cause said ignition of the first effects charge;

a second effects charge positioned in the interior volume of the second casing for creating a second pyrotechnic display when ignited;

a plug that extends across an inner cross section of the first casing and is positioned in the first casing opposite the first effects charge from the lift charge, said plug having an opening for allowing fire resulting from said first effects charge when ignited to pass through the first plug to cause said igniting of the second effects charge;

a second delay fuse operably associated with said second effects charge and the ignition source to cause the second delay fuse to burn as a result of ignition by the ignition source and thereby cause said ignition of the second effects charge a preselected period of time after said ignition of the first effects charge;

a third cylindrical casing positioned end-to-end with said second cylindrical casing;

a third effects charge positioned in the interior volume of the third casing for creating a third pyrotechnic display when ignited;

a second plug positioned in the second casing opposite the second effects charge from the first cylindrical casing and having an opening for allowing an ignition source to pass through the second plug to cause said igniting of the third effects charge a preselected period of time following ignition of the second effects charge; and an outer casing surrounding at least parts of said first, second and third casings and comprising first, second and third partially ball-shaped segments.

21. A method of creating a multiple effect pyrotechnic display, comprising the steps of:

launching a fireworks aerial display shell comprising first and second casings of cylindrical configuration and positioned in end-to-end relationship, each of said first and second casings presenting opposite first and second ends and defining an interior volume;

creating a first pyrotechnic display after said launching of the fireworks aerial display shell by igniting a first effects charge positioned in the interior volume of the first casing;

then creating a second pyrotechnic display by igniting a second effects charge positioned in the interior volume of the second casing, said igniting of the second effect charge occurring as a result of passing an ignition source through an opening in a plug that extends across an inner cross section of the first casing and is positioned in the first casing between the first effects charge and the second effects charge.

* * * * *